US010011139B2

(12) United States Patent
Hug et al.

(10) Patent No.: US 10,011,139 B2
(45) Date of Patent: Jul. 3, 2018

(54) DEVICE FOR PROCESSING THE PROJECTING SPINE OF A BOOK BLOCK SUSPENDED FROM A CIRCULATING CLAMP ON A BOOKBINDING MACHINE

(75) Inventors: Theo Hug, Wallenwil (CH); Harald Alber, Radolfzell (DE); Erwin Meienberger, Lanterswil (CH); Christian Abegglen, Frauenfeld (CH)

(73) Assignee: MUELLER MARTINI HOLDING AG, Hergiswil (CH)

( * ) Notice: Subject to any disclaimer, the term of this patent is extended or adjusted under 35 U.S.C. 154(b) by 547 days.

(21) Appl. No.: 12/484,738

(22) Filed: Jun. 15, 2009

(65) Prior Publication Data

US 2009/0311078 A1 Dec. 17, 2009

(30) Foreign Application Priority Data

Jun. 13, 2008 (EP) ..... 08405157

(51) Int. Cl.

| | |
|---|---|
| ***B42C 13/00*** | (2006.01) |
| ***B42C 9/00*** | (2006.01) |
| ***B42C 7/00*** | (2006.01) |
| ***B42B 5/00*** | (2006.01) |
| ***B42C 19/08*** | (2006.01) |
| ***B42C 5/04*** | (2006.01) |

(52) U.S. Cl.

CPC ..... *B42C 19/08* (2013.01); *B42C 5/04* (2013.01)

(58) Field of Classification Search

CPC .. B42C 9/00; B42C 7/00; B42C 13/00; B42C 5/04; B42C 19/08; B42B 5/00

USPC ..... 412/1, 3, 6, 9, 11, 14, 22, 33

See application file for complete search history.

(56) References Cited

U.S. PATENT DOCUMENTS 2,010,810 A * 8/1935 Bredenberg ..... B42C 5/02 412/30
3,466,682 A * 9/1969 French ..... B42C 11/04 412/19
3,478,378 A * 11/1969 Glasgow ..... 412/11

(Continued)

FOREIGN PATENT DOCUMENTS

EP 198 59 330 7/2000
EP 199 26 407 12/2000

(Continued)

OTHER PUBLICATIONS

European Patent Office Action (EPO form 2001) issued in EP 08 405 157.2-2304 dated Mar. 23, 2012.

(Continued)

*Primary Examiner* — Justin V Lewis
(74) *Attorney, Agent, or Firm* — Fisherbroyles, LLP; Robert Kinberg

(57) ABSTRACT

A device for processing a spine of a book block suspended from a circulating clamp on a conveyor of a bookbinding machine includes a processing device positioned opposite the clamp and facing the spine of the book block. A tensioning device is includes a fixed support roller to act perpendicularly on one side of the clamp and an overhang of the book block, and an adjustable pressing roller to act perpendicularly on another side of the clamp and the overhang of the book block. A controlled adjusting device is connected to the adjustable pressing roller. The controlled adjusting device adjusts the adjustable pressing roller based on a thickness of the book block.

10 Claims, 2 Drawing Sheets

(56) References Cited

U.S. PATENT DOCUMENTS

| | | | | |
|---|---|---|---|---|
| 5,114,292 | A * | 5/1992 | Geiser | B42C 19/08 412/11 |
| 6,186,721 | B1 * | 2/2001 | Ganter | B42C 11/04 412/19 |
| 2003/0198534 | A1 * | 10/2003 | Valentinis | B42B 4/00 412/9 |
| 2005/0008460 | A1 * | 1/2005 | Watkiss | 412/9 |
| 2005/0207870 | A1 * | 9/2005 | Muller | B42C 19/08 412/33 |
| 2007/0122256 | A1 * | 5/2007 | Toyoizumi et al. | 412/37 |
| 2008/0231970 | A1 * | 9/2008 | Henderson | 359/696 |
| 2009/0116935 | A1 * | 5/2009 | Porat | 412/3 |

FOREIGN PATENT DOCUMENTS

| | | |
|---|---|---|
| EP | 1437233 A1 | 7/2004 |
| EP | 1 504 922 | 2/2005 |
| EP | 1 674 285 | 6/2006 |

OTHER PUBLICATIONS

European Search Report dated Oct. 28, 2008 of European Application No. 08405157.2.

* cited by examiner

DEVICE FOR PROCESSING THE PROJECTING SPINE OF A BOOK BLOCK SUSPENDED FROM A CIRCULATING CLAMP ON A BOOKBINDING MACHINE

CROSS-REFERENCE TO RELATED APPLICATIONS

This application claims the priority of European Patent Application No. 08405157.2, filed on Jun. 13, 2008, the entire content of which is incorporated herein by reference.

BACKGROUND OF THE INVENTION

The invention relates to an arrangement for processing the projecting spine of a book block suspended from a circulating clamp on a bookbinding machine. The arrangement comprises a processing device that faces the book block spine and is installed opposite the clamp on the conveyor, as well as a corresponding tensioning device that acts perpendicularly on the clamp and the overhanging portion of the book block from both sides. The tensioning device includes a locally fixed support roller and an adjustable pressing roller.

Arrangements of the aforementioned type are used for processing the spines of book blocks in bookbinding machines used for further print processing. In the process, printed sheets or signatures are collected ahead of time in a collating machine and combined into loose book blocks. The loose book blocks are then transferred with their spines pointing downward to the clamps of a circulating conveyor on the bookbinding machine, and are clamped in. The book blocks, which are suspended in the clamps, are then moved past processing devices arranged along the conveying path. The processing devices process the spine and the adjacent side flanks of the book blocks. The clamps must exert a sufficient clamping force onto the book blocks to safely absorb the forces acting upon the book blocks during processing, and/or to prevent displacement of the book blocks inside the clamps. The minimum required clamping force depends on the type of processing, and the consistency of the book blocks. The minimum required clamping force is primarily low along the conveying path. However, one exception is the spine-processing station, which requires a high clamping force since the book blocks could otherwise be pulled from the clamp during the processing.

It has proven useful to have the clamps themselves exert a low clamping force, and to provide an additional, supporting force in the spine processing region. The additional supporting force acts from the outside upon the clamps. According to prior art, this additional force is exerted onto the clamps in the spine processing region by two rollers that the clamp moves between. The pressing roller acting upon the adjustable clamping jaw in the front is spring-loaded. The support roller acting upon the rear clamping jaw is fixed to the machine frame. The additional force to be exerted onto the clamp can be adjusted by adjusting the pre-tensioning of the spring. The distance between the pressing roller and the support roller can furthermore be selected, so as to adjust to the book thickness. As a result of the linear spring rate for the spring-loading of the pressing roller, small thickness differences between the book blocks do not cause substantial changes in the additional force. The position of the pressing roller, however, changes corresponding to the thickness differences. It has turned out that with larger thickness differences for the book blocks, such as are encountered when producing printed products according to client profiles, the dynamic forces become excessively high as a result of the acceleration and delay of the pressing roller transverse to the clamp, and the force required for the processing can no longer be ensured. In addition, with larger thickness differences, the clamps and rollers are subjected to increased stress, which can result in additional wear and tear. This effect is further increased with perfect binders operating at high production speeds.

SUMMARY OF THE INVENTION

It is therefore an object of the present invention to create a device as described above, which transmits a predetermined force onto the clamps with the aid of the pressing roller and the support roller, regardless of the thickness of a book block.

This object can be solved according to the invention by combining the pressing roller with a controlled adjusting device that reacts to a change in the thickness of the book block.

According to one embodiment of the invention, there is provided a device for processing a spine of a book block suspended from a circulating clamp on a conveyor of a bookbinding machine, the device comprising: a processing device for being positioned opposite the clamp and facing the spine of the book block; a tensioning device associated with the processing device, wherein the tensioning device comprises a fixed support roller to act perpendicularly on one side of the clamp and an overhang of the book block, and an adjustable pressing roller to act perpendicularly on another side of the clamp and the overhang of the book block; and a controlled adjusting device connected to the adjustable pressing roller, wherein the controlled adjusting device adjusts the adjustable pressing roller based on a thickness of the book block.

BRIEF DESCRIPTION OF THE DRAWINGS

These and other features and advantages of the invention will be further understood from the following detailed description with reference to the accompanying drawings, to which we refer for all details not mentioned in the description, wherein.

DETAILED DESCRIPTION OF THE PREFERRED EMBODIMENTS

Figure 1:
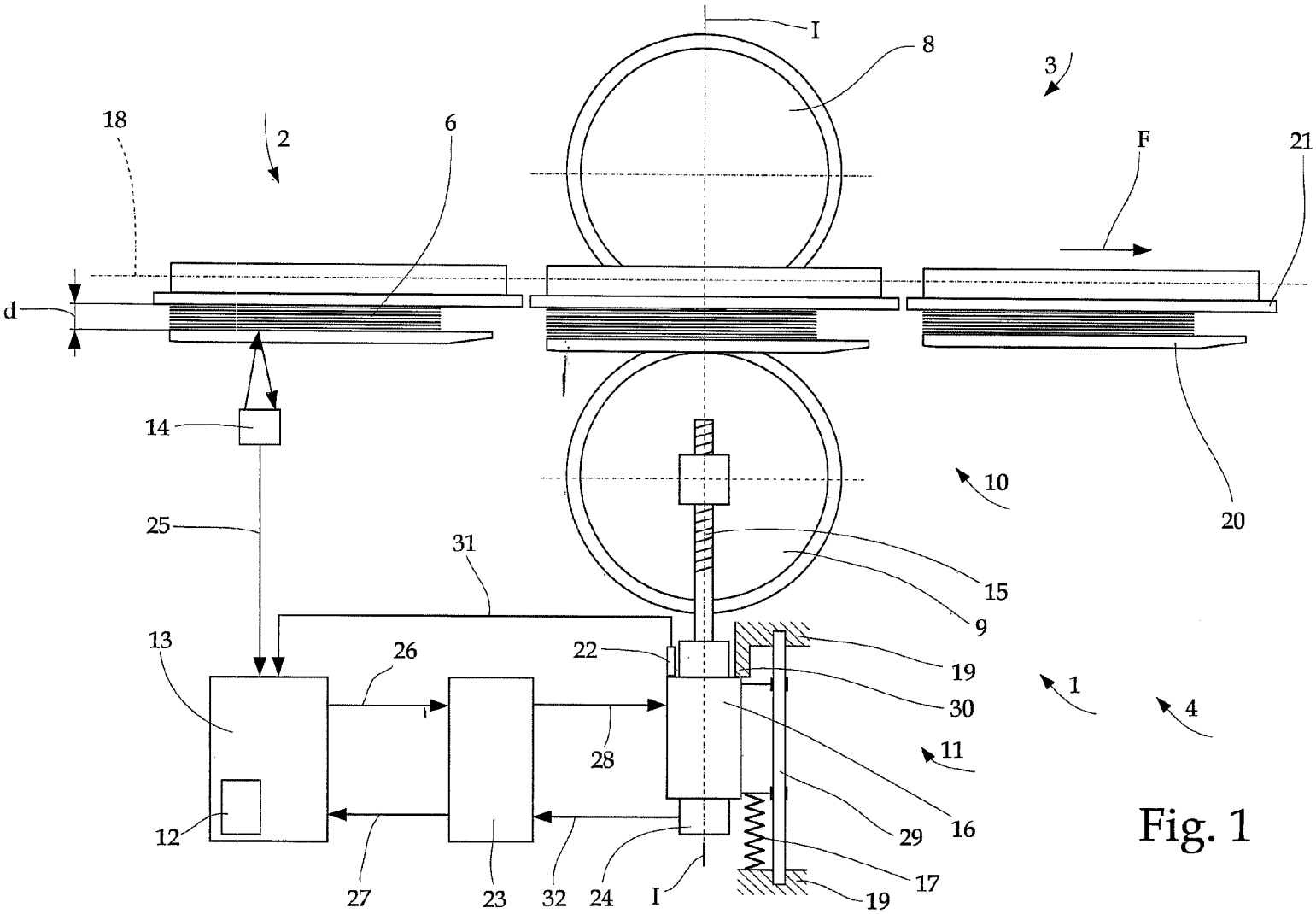
FIG. 1 is simplified top view of a device according to the invention.
Figure 2:
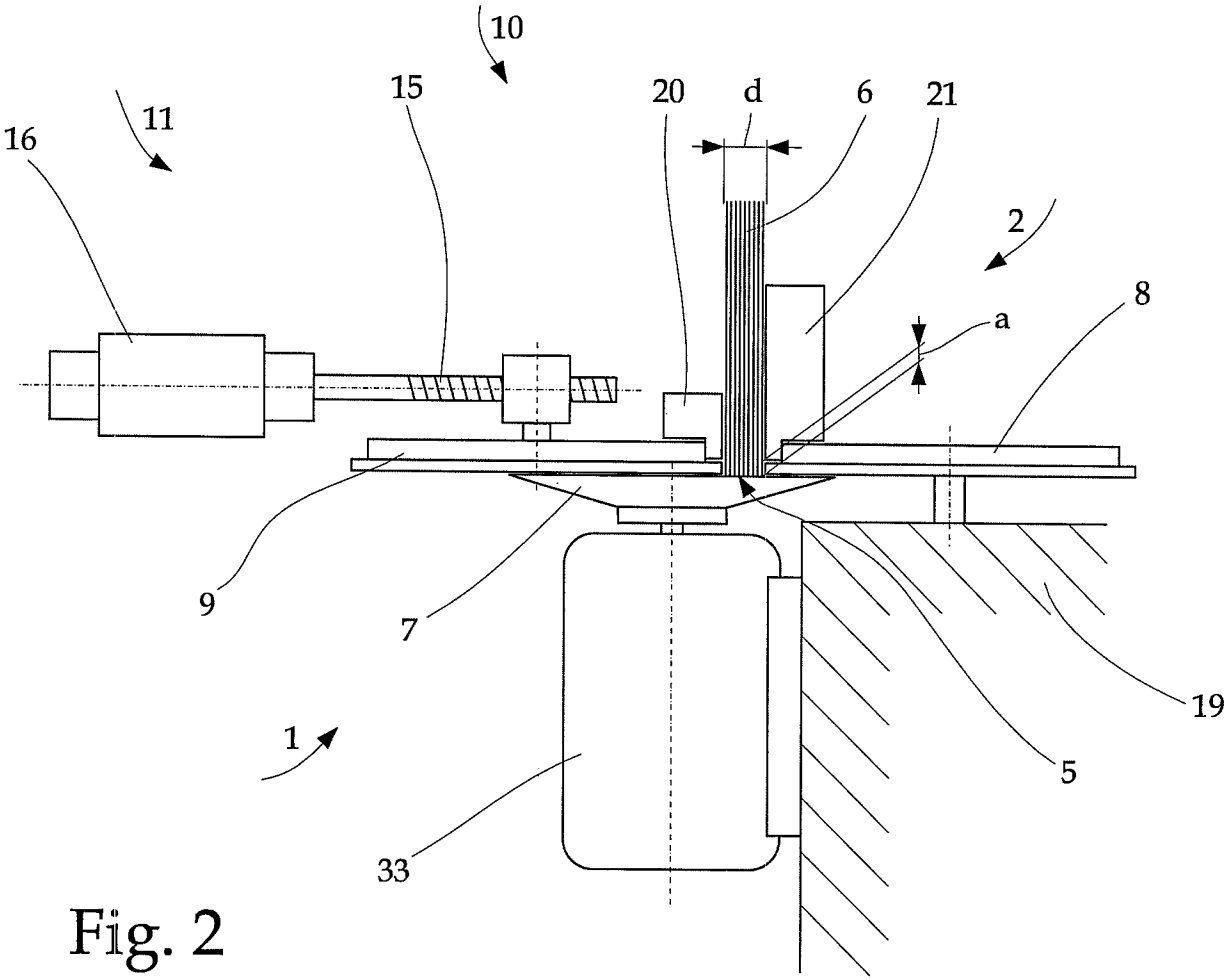
FIG. 2 is a sectional view taken along the line I-I of FIG. 1, viewed counter to the conveying direction.

The illustrative processing device 1 shown in FIGS. 1 and 2 is intended for the processing of the projecting spine 5 (see FIG. 2) of a book block 6 that is suspended from a circulating clamp 2 attached to a conveyor 3 for a bookbinding machine 4. The clamp 2 can be driven in a conveying direction F with the aid of a traction device 18. According to one embodiment, the clamp 18 clamp 2 comprises a rear clamping jaw 21 and a front clamping jaw 20. The front clamping jaw 20 can be adjusted relative to the rear clamping jaw 21 in a direction transverse to the conveying direction F. According to one embodiment, the front clamping jaw 20 can be tensioned with a spring (not shown) against the rear clamping jaw 21. As shown, the processing device 1 can be positioned along the conveyor 3 opposite the clamp 2 and facing the book spine 5. At least during processing with the processing device 1, the clamp 2 and/or the book block 6 can be acted on by an additional clamping force. This additional clamping force can be generated by a tensioning device 10, assigned to the processing device 1. The tensioning device 10 can act perpendicularly upon the clamp 2 and overhanging portion a of the book block 6 from two sides. According to an embodiment, the book block comprises a locally fixed support roller 8, as well as an adjustable pressing roller 9. For process-technical reasons, the pressing roller 9 and the support roller 8 can have a two-part design and/or can comprise cylindrical, disk-shaped bodies, wherein the small-diameter disks press onto the clamping jaws 20, 21 of the clamp 2, and the large-diameter disks act upon the side flanges of the book block 6. The support roller 8 and the pressing roller 9 can be driven with the aid of frictional contact between the small-diameter disks and the clamping jaws 20, 21.

According to an embodiment, the pressing roller 9 can be connected to a controlled adjusting device 11, which reacts to a change in the thickness d of the book blocks 6. The book block spine 5 can be processed as the clamps 2 are conveyed in the conveying direction F past the processing device 1, which can be arranged stationary on the machine frame 19.

The adjusting device 11 can be connected to a measuring device 14 via a control unit 13 provided with a data memory 12 for storing specific book thicknesses d. The measuring device 14 can be arranged upstream of the processing device 1, and can be used for measuring the thickness d of a book block 6 conveyed by the conveyor 3. The thickness d can be measured directly on the book block 6 or indirectly via the position of the front clamping jaw 20. The distance between the upstream-arranged measuring device 14 and the processing device 1 is not critical for an error-free operation of the processing device 1. According to an another embodiment, several measuring devices 14 can be used during the process of gathering the individual printed sheets into book blocks 6, in order to measure each individual sheet and add up the measuring results to be stored in the data memory 12.

The embodiment shown in FIG. 2 relates to a milling machine for cutting off the back folds of the book block 6, and comprises a milling mechanism 7, and a motor 33 that is connected to the machine frame 19 and drives the milling mechanism 7. However, the invention is not limited to a milling machine, but can also be used for other types of processing devices 1 on a bookbinding machine 4, such as notching stations, devices for applying glue to the spine, or press-on stations. In one embodiment, the adjusting device 11 includes a rotational-angle controlled motor 16 (e.g., servo-motor) that is drive-connected to a spindle 15.

Alternatively, the adjusting device 11 can be embodied as a linear drive. According to one embodiment, the drive may be a servo drive, comprising at least one motor 16, a drive control 23 with variance comparison for the position, rotational moment, and speed, as well as a position-measuring device 24 for measuring the position of the pressing roller 9 transverse to the conveying direction F. The control unit 13 can be the machine control, which can exchange data via a data line (not shown) with a superior control or with other machine controls. The values measured with the measuring device 14 for the thicknesses d of the book blocks 6 can be detected by the control unit 13 via a line 25, and stored in the data memory 12. These values can be used to compute the desired position for the pressing roller 9. All desired values can be transmitted by the control unit 13 via an output line 26 to the drive control 23. Feedback from the drive control 23 can occur via an input line 27, wherein the output line 26 and the input line 27 can be embodied as serial or as parallel data bus. Control units are also known from the prior art, which are capable of realizing all functions of the control unit 13 and the drive control 23 with a single control unit. The drive control 23 can supply the motor 16 with the required energy via an energy supply line 28, and can record the position of the drive and/or the pressing roller 9 via a line 32 that is connected to the position measuring device 24. Prior to the arrival of each clamp 2 at the processing device 1, the control unit 13 transmits the value for the thickness d of the book block 6, clamped into the clamp 2, to the drive control 23. The motor 16 can be adjusted to the specified value by the drive control 23 and/or the pressing roller 9 can be moved to the position corresponding to the thickness d. When the clamp 2 has moved between the pressing roller 9 and the support roller 8, the drive control 23 switches from position control to torque and/or force control. On the one hand, this can allow a constant force to be exerted onto the clamp 2 by the pressing roller 9 while, on the other hand, it can allow small measuring errors caused by the differences in the elasticity of the book blocks 6 to be compensated for.

Before the clamp 2 leaves the region of contact formed by the pressing roller 9 and the support roller 8, the drive control again switches from torque control to position control, and adjusts the pressing roller 9 to the thickness d of the following book block 6 to be processed.

The adjusting device 11 can be positioned on a guide 29 that is connected to the machine frame 19, such that it can be moved transverse to the conveying direction F. The adjusting device can come to rest against an end stop 30 that is supported on a pre-tensioned spring 17, which is connected to the machine frame 19. The force generated by the adjusting device 11 can be smaller than the pre-tensioning force of the spring 17. According to one embodiment, the displacement of the adjusting device 11 can be omitted. However, if provided, the displacement can provide overload protection if the pressing roller 9 is not in the correct position as the result of an error, or if a clamp that is not completely closed moves between the pressing roller 9 and the support roller 8. In those cases, the adjusting device 11 can be pressed away from the end stop 30, while a sensor 22 simultaneously generates an error signal, which can be transmitted via a sensor line 31 to the control unit 13, whereupon the control unit 13 stops the bookbinding machine 4. According to one embodiment for processing printed products with the same thicknesses d, it may be possible to dispense with the continuous adjustment of the adjusting device 11, and/or the processing device 1 can be operated as disclosed in the prior art.

It will be understood that the above description of the present invention is susceptible to various modifications, changes and adaptations, and the same are intended to be comprehended within the meaning and range of equivalents of the appended claims.

The invention claimed is:

1. A device for processing a spine of a book block, comprising:

a circulating clamp suspended from a conveyor of a bookbinding machine, the clamp having a first jaw adapted to directly contact one side of the book block, and a second jaw adapted to directly contact another side of the book block, wherein the book block has a portion overhanging from the jaws and the jaws each have a stepped region presenting a step surface parallel to the respective sides of the book block;

a processing device positioned opposite the clamp and facing the spine of the book block;

a tensioning device comprising:

a fixed support roller configured to engage the step surface of the first jaw on the one side of the book block to press the first jaw inwardly directly against the book block and also to engage the overhang portion of the book block on the one side of the book block, and an adjustable pressing roller configured to engage the step surface of the second jaw on the other side of the book block to press the second jaw inwardly directly against the book block and also to engage the overhang portion on the other side of the book block; and a controlled feeding device connected to the adjustable pressing roller, wherein the controlled feeding device adjusts the adjustable pressing roller based on a measured thickness of the book block.

2. The device of claim 1, further comprising:

a control unit including a data memory; and a measuring device adapted to measure the thickness of a subsequent book block conveyed by the conveyor;

wherein the feeding device is connected to the measuring device by the control unit.

3. The device of claim 1, further comprising a control unit including a data memory for storing specific book thicknesses, wherein the controlled feeding device is connected to the control unit.

4. The device of claim 1, wherein the feeding device comprises a spindle and a servo motor drive-connected to the spindle.

5. The device of claim 1, wherein the feeding device comprises a linear drive.

6. The device of claim 1, further comprising a pre-tensioned spring supporting the feeding device.

7. The device of claim 6, wherein the pre-tensioned spring generates a pre-tension force, and the feeding device generates a feeding force that is lower than the pre-tension force.

8. A device for processing a spine of a book block suspended from a circulating clamp on a conveyor of a bookbinding machine, the circulating clamp having a first jaw adapted to directly contact one side of the book block, and a second jaw adapted to directly contact another side of the book block, wherein the book block has a portion overhanging from the jaws and the jaws each have a stepped region presenting a step surface parallel to the respective sides of the book block; the device comprising:

a processing device positioned opposite the clamp and facing the spine of the book block;

a tensioning device comprising:

a fixed support roller configured to engage the step surface of the one jaw on the one side of the book block, pressing the first jaw inwardly directly against the book block and also to engage the overhang portion of the book block on the one side of the book block, and an adjustable pressing roller configured to engage the step surface of the second jaw on the other side of the book block, pressing the second jaw inwardly directly against the book block and also to engage the overhang portion of the book block on the other side of the book block;

a measuring device located upstream from the adjustable pressing roller, wherein the measuring device is adapted to measure the thickness of the book block conveyed by the conveyor; and a controlled feeding device connected to the adjustable pressing roller, wherein the controlled feeding device is adapted to receive the thickness of the book block from the measuring device and adjust the adjustable pressing roller based on the thickness of the book block.

9. The device of claim 1, wherein the fixed support roller and the adjustable pressing roller are each configured to have a surface that is parallel to the respective sides of the book block, to engage the respective step surfaces of the first and second jaws to press the first and second jaws directly against the book block.

10. The device of claim 8, wherein the fixed support roller and the adjustable pressing roller are each configured to have a surface that is parallel to the respective sides of the book block, to engage the respective step surfaces of the first and second jaws, to press the first and second jaws directly against the book block.

* * * * *